United States Patent [19]

Rasmussen

[11] 4,040,699

[45] Aug. 9, 1977

[54] FEMALE CONNECTOR AND ESCUTCHEON PLATE COMBINED THEREWITH FOR TELEPHONE EQUIPMENT

[75] Inventor: Harry R. Rasmussen, Tacoma, Wash.

[73] Assignee: Crest Industries, Inc., Puyallup, Wash.

[21] Appl. No.: 733,227

[22] Filed: Oct. 18, 1976

[51] Int. Cl.[2] ..... H01R 9/08; H01R 13/54

[52] U.S. Cl. ..... 339/91 R; 339/99 R; 339/126 R; 339/176 R

[58] Field of Search ..... 339/97 R, 99 R, 91 R, 339/263 R, 125, 126, 176 M, 176 P, 176 R; 174/58

[56] References Cited

U.S. PATENT DOCUMENTS

| | | | |
|---|---|---|---|
| 3,619,476 | 11/1971 | Rasmussen | 174/58 |
| 3,761,869 | 9/1973 | Hardesty et al. | 339/99 R |
| 3,835,445 | 9/1974 | Hardesty | 339/99 R |
| 3,850,497 | 11/1974 | Krumreich et al. | 339/126 R |

*Primary Examiner*—Roy Lake
*Assistant Examiner*—E. F. Desmond
*Attorney, Agent, or Firm*—Christensen, O'Connor, Garrison & Havelka

[57] ABSTRACT

A plate, such as an escutcheon plate designed to overlie and cover a wall-mounted outlet receptacle, is provided with a centrally-located aperture extending therethrough which is aligned with a central cavity in a body member upon assembly. Both the aperture and cavity are configured to receive and retain a standardized male connector such as that disclosed in U.S. Pat. No. 3,761,869, Hardesty et al. A plurality of first grooves are provided in a lower surface of the central cavity of the body member and communicate with a corresponding plurality of bores through the body member, each of which in turn communicates by means of a second groove with one of a plurality of terminal-receiving cavities in the body member. A conductor is located in each one of the plurality of bores and has a first wire spring contact portion located within one of the plurality of first grooves and partially extending into the central cavity for engaging a corresponding contact in the male connector. A second portion of each conductor lies in the corresponding second groove and terminates in the corresponding terminal-receiving cavity, wherein it is clamped between a nut and a spacer by a machine screw to form the electrical terminal and to also allow interconnection with one of a plurality of leads pulled into the outlet receptacle. An embodiment of the invention is also disclosed wherein the body member is assembled with an adapter plate having a centrally-located aperture, with the adapter plate being configured to be installed in a wall-mounted outlet receptacle and to protrude through a centrally-located, knockout aperture of an escutcheon plate.

8 Claims, 8 Drawing Figures

Fig. 1.
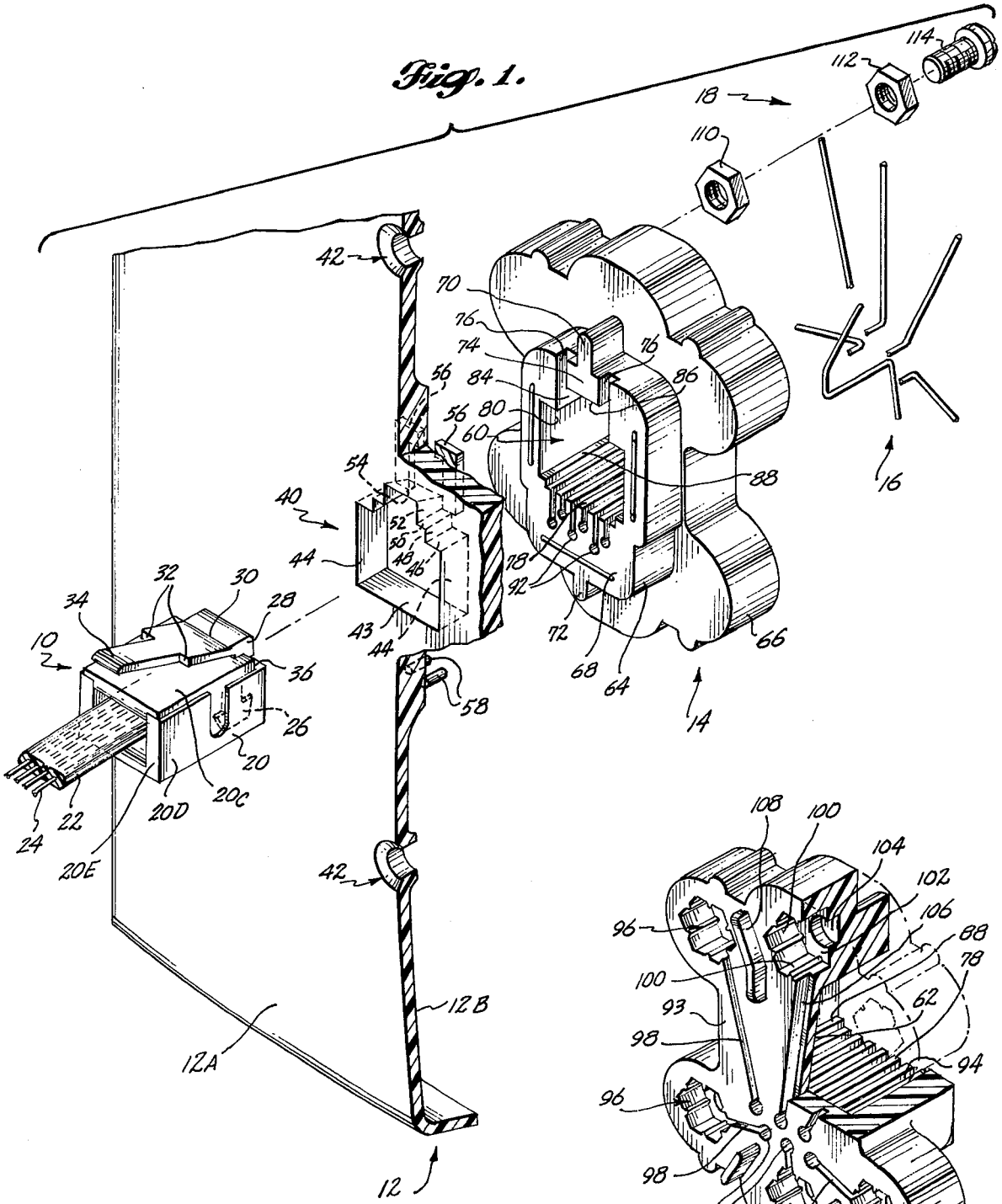
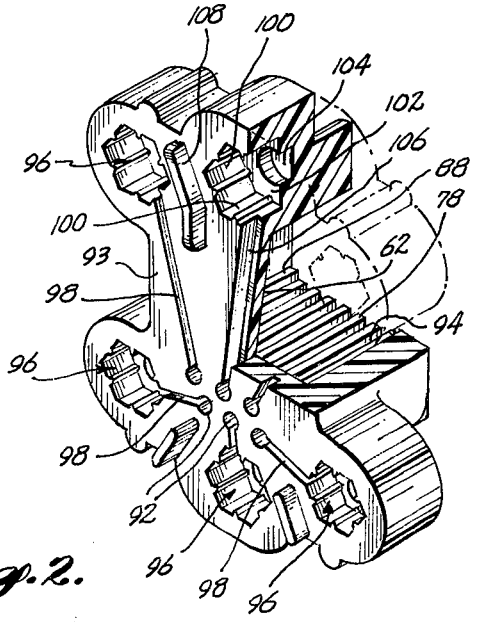
Fig. 2.

FEMALE CONNECTOR AND ESCUTCHEON PLATE COMBINED THEREWITH FOR TELEPHONE EQUIPMENT

FIELD OF THE INVENTION

This invention generally relates to an electrical termination for telephone equipment, and, more particularly, to such an electrical termination including a female connector and escutcheon plate combined therewith which is adapted to be installed in wall-mounted outlet receptacles.

BACKGROUND OF THE INVENTION

With individuals and businesses now being able to purchase their own telephone equipment, including telephone desk sets, and use such equipment in conjunction with the telephone system, it is desirable to have a reliable apparatus for connecting and disconnecting such telephone equipment to and from the telephone system. Typically, a number of electrical terminations for the telephone system are provided throughout a business or residence, with each electrical termination being installed in a respective outlet receptacle which is usually wall-mounted. In a majority of the installations in the prior art, the electrical termination simply comprised the ends of a plurality of conductors including a telephone line pair and associated power supply leads (for dial lights and other indicators). Each wall-mounted receptacle was covered by an escutcheon plate having a centrally-located aperture. To install a telephone desk set or other item of telephone equipment, the escutcheon plate had to be removed, a cable from the telephone desk set or other equipment passed through the centrally-located aperture thereof, and the respective ends of the cable and the conductors comprising the electrical termination spliced together. Obviously, such an operation required the services of a telephone installer.

The prior art also teaches an electrical termination comprising a multi-pin female connector having a plurality of electrical terminals for connection to the ends of the telephone line pair and the other leads in the outlet receptacle and adapted to be mounted in the receptacle, with a portion of the female connector being exposed through the centrally-located aperture of the escutcheon plate when the escutcheon plate is reinstalled. Although such female connectors require the services of a telephone installer when first installed, it is clear that the telephone user thereafter can add or remove a particular piece of telephone equipment to and from the telephone system if that telephone equipment is afforded with a cable having a mating male connector.

Such prior art female connectors have, however, been bulky, difficult to initially install, and, most important, non-standard in their configuration, thereby requiring a specific male connector for each type of female connector that is utilized.

It is therefore an object of this invention to provide an electrical termination for telephone equipment including an improved female connector which is small in size and yet easy to initially install in a wall-mounted outlet receptacle.

It is another object of this invention to provide such an electrical termination which can be easily and inexpensively manufactured, while yet affording reliable connection and disconnection of telephone equipment.

It is a further object of this invention to provide such an electrical termination which includes an improved female connector adapted to mate with a standardized male connector utilized by most telephone companies.

It is yet another object of this invention to provide such an electrical termination including, in one embodiment, an improved female connector combined with an escutcheon plate.

It is still another object of this invention to provide such an electrical termination including, in another embodiment, an improved female connector designed to be installed together with the escutcheon plate of the prior art having a centrally-located aperture.

SUMMARY OF THE INVENTION

Briefly, these objects and others will be realized from a consideration of the following portion of the specification are achieved by the provision of an electrical termination including a female connector for telephone equipment which is adapted to be installed in wall-mounted outlet receptacles having pulled therein a plurality of electrical leads. The electrical terminal is for use with a male connector including a body formed from dielectric material, the body being of substantially parallelopiped configuration and having a front surface and an adjoining lower surface, the male connector further including a plurality of metallic, flat blade contacts disposed in the body an spaced apart from each other, the flat blade contacts being exposed to the exterior of the body through the front and lower surfaces thereof.

The electrical termination comprises plate means formed from dielectric material and including means for securing the plate means to the outlet receptacle, the plate means having a front surface, a back surface, and a connector-receiving aperture defined therein by a plurality of surfaces, including a lower surface, extending from the front surface to the back surface so that the connector-receiving aperture is generally complementary to the body of the male connector.

A body member formed from dielectric material is also provided which has a first surface and a second surface, a connector-receiving cavity being defined in the body member and extending inwardly from the first surface of the body member to a rear surface situated within the body member. The body member is joined to the plate means with the first surface of the body member adjoining the rear surface of the plate means. The connector-receiving cavity in the body member is also defined by a plurality of surfaces, including a lower surface, extending from the first surface to the rear surface, the plurality of surfaces generally corresponding to and being aligned with the plurality of surfaces of the plate means in assembly so that the connector-receiving cavity is also complementary to the body of the male connector. A plurality of bores are defined in the body member and are spaced apart from each other and extend through the body member from the first surface of the second surface. The plurality of first grooves are spaced apart from each other in the lower surface of the connector-receiver cavity and extend from the first surface inwardly, with each of the plurality of first grooves communicating adjacent the first surface with a corresponding one of the plurality of bores. A plurality of terminal-receiving cavities extend inwardly into the body member from the second surface, with a plurality of second grooves being provided in the second surface of the body member, each of the plurality of second grooves interconnecting one of the plurality of terminal-receiving cavities with a corresponding one of the plurality of bores.

A plurality of electrical conductors are provided, each being formed into a first wire spring contact portion located within one of the plurality of first grooves and extending from the first surface of the body member inwardly into the connector-receiving cavity for engaging a corresponding one of the plurality of flat blade contacts upon insertion of the male connector into the connector-receiving cavity through the connector-receiving aperture. Each of the plurality of conductors also is formed into a second portion located in the corresponding one of the plurality of bores and second grooves and terminating in a corresponding one of the plurality of terminal-receiving cavities.

Finally, a plurality of electrical terminal means are provided, each of the electrical terminal means being located within one of the plurality of terminal-receiving cavities and providing electrical interconnection between the termination of the corresponding oen fo the plurality of electrical conductors located therein and one of the plurality of leads in the outlet receptacle.

BRIEF DESCRIPTION OF THE DRAWINGS

The invention can perhaps best be understood by referring to the following portion of the specification, taken in conjunction with the accompanying drawings, in which:

FIG. 1 is an exploded pictorial view showing the component parts of a first embodiment of the present invention including a combined escutcheon plate and female connector of the present invention, and also illustrating a standardized telephone system male connector for use therewith;

FIG. 2 is a pictorial view showing the rear of a body member of the female connector of FIG. 1;

DESCRIPTION OF A PREFERRED EMBODIMENT

Figure 3:
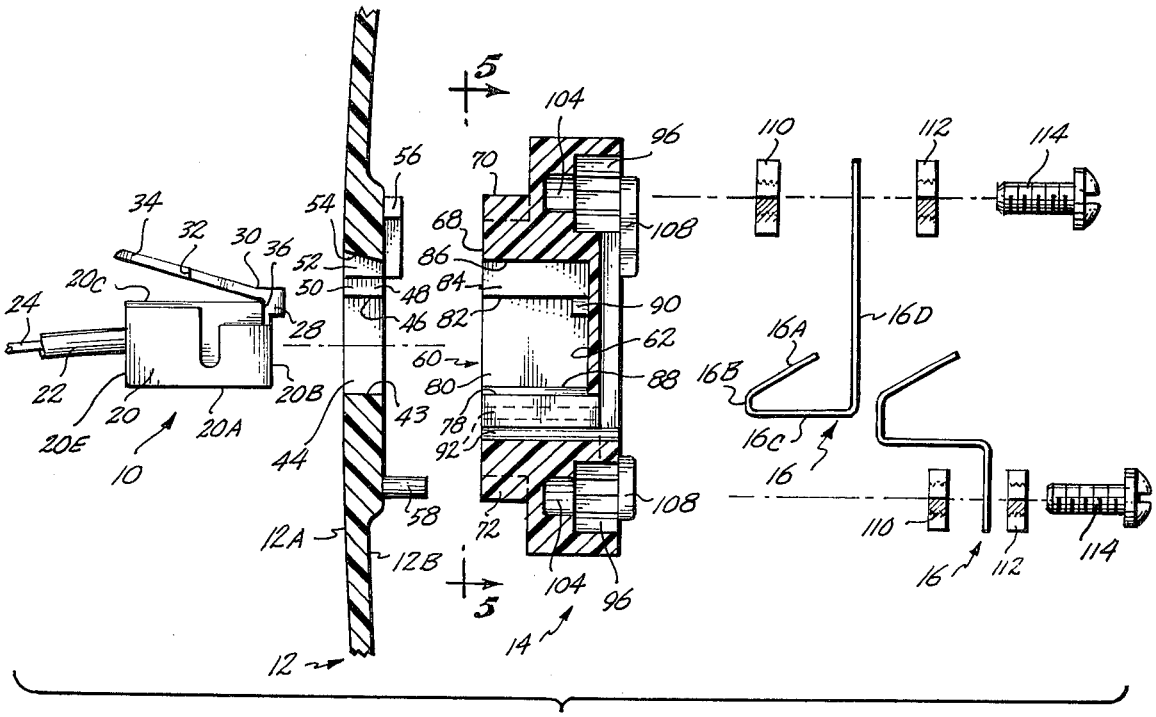
FIG. 3 is an exploded side elevation view generally corresponding to FIG. 1.

With reference now to FIG. 1, a male connector 10 is illustrated which is similar to a type described in more detail in U.S. Pat. No. 3,761,869, Hardesty et al., which is expressly incorporated by reference herein. Male connectors of this type have found increasing acceptance as a standard connector for user-operated telephone equipment such as telephone desk sets.

The electrical termination of the present invention includes an escutcheon plate 12 having a centrally-located, connector-receiving aperture 40 extending therethrough from a front surface 12A to a back surface 12B thereof; a body member 14 having a centrally-located, connector-receiving cavity 60 which is aligned with aperture 40 in assembly; a plurality of conductors 16 having first contact portions thereof situated within the cavity 60 for engaging corresponding contacts of the male connector 10, and second portions thereof for providing electrical connection to a plurality of leads within an outlet receptacle, such as the telephone line pair and associated power supply leads; and a plurality of electrical terminals 18, only one of which is shown in FIG. 1, which are received in the body member 14 for securing the second portions of conductors 16 to the leads within the outlet receptacle.

The escutcheon plate 12, body member 14, conductors 16, and terminals 18 in assembly from a combined escutcheon plate and female connector, with the female connector being generally similar to that described in U.S. Pat. No. 3,850,497, Krumreich et al., which is expressly incorporated by reference herein. However, the present invention possesses significant advantages over the female connector described in U.S. Pat. No. 3,850,497, as will be hereinafter apparent to those skilled in the art.

The male connector 10 includes a body 20, of substantially parallelopiped configuration, having a lower surface 20A, a front surface 20B, an upper surface 20C, a pair of side surfaces 20D, and a back surface 20E. Included in the body 20 are means for terminating a plurality of electrical conductors 24 forming part of an insulated, flat cable 22, the means comprising a plurality of flat blade contacts 26 which are spaced apart and generally located in correspondence to the arrangement of the plurality of conductors 24 in cable 22. As explained in detail in the aforementioned U.S. Pat. No. 3,761,869, the flat blade contacts 26 are exposed to the exterior of body 20 with a portion of each contact being located in a corresponding groove extending inwardly from the front surface 20B and the lower surface 20A. A ledge 28 forms part of and extends from the front surface 20B of body 20 and has a portion extending over and integral with upper surface 20C. An integral hinge 30 joins the ledge 28 to a first end of a tab 34 which extends at an angle with respect to upper surface 20C and which has a second end terminating just beyond surface 20E. The second end of tab 32 is necked-down from the first end thereof to define a pair of locking shoulders 32 on the sides of tab 34 intermediate its termination and its juncture with integral hinge 30. Finally, a pair of stop shoulders 36 are formed in body 20 on either side of ledge 28 and at the forward edge of upper surface 20C, but indented from front surface 20B.

The component elements of male connector 10, excluding the plurality of flat blade contacts 26, are conventionally formed by injection molding from a dielectric, insulating material.

Figure 6:
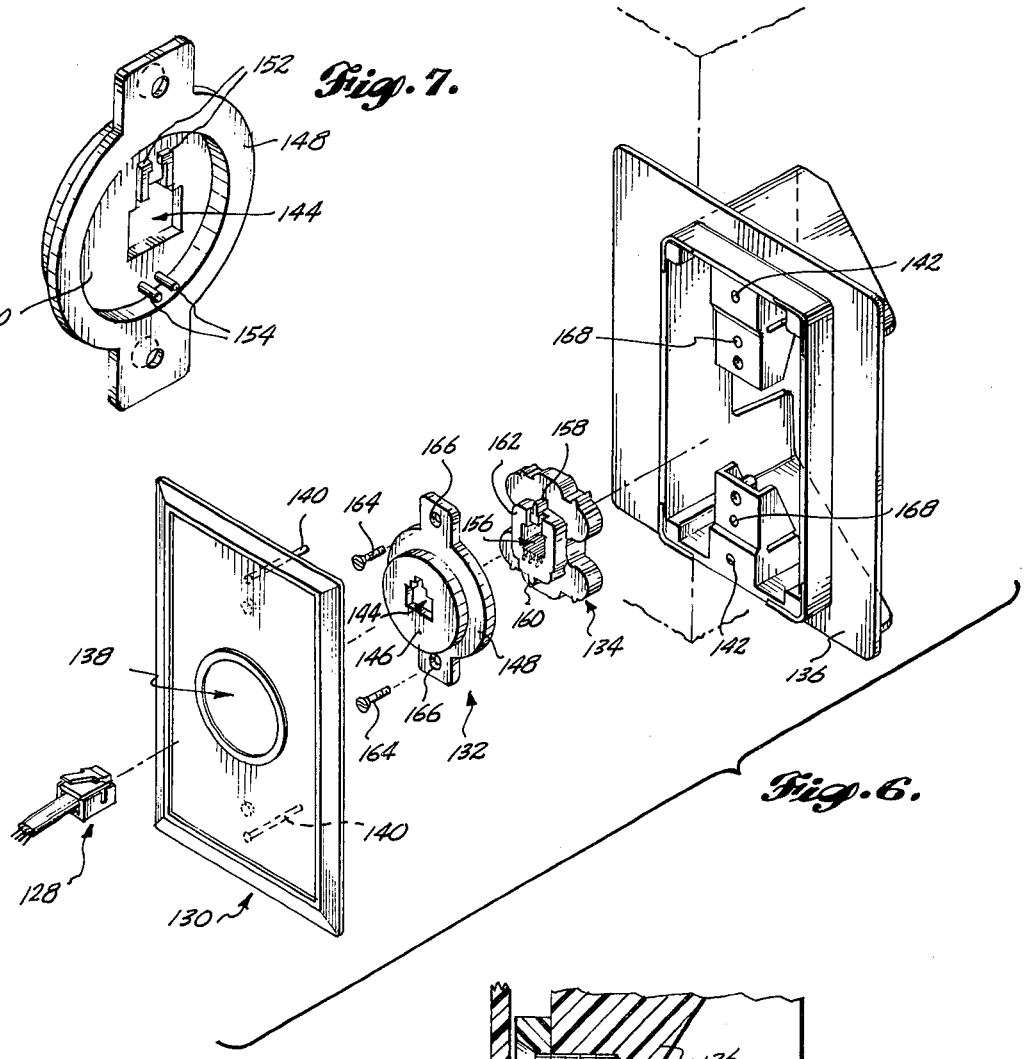
FIG. 6 is an exploded pictorial view showing the component parts of a second embodiment of the present invention including a combined adapter plate and female connector.

The escutcheon plate 12, which is also injection-molded from a dielectric, insulating material, includes a pair of apertures 42 extending therethrough from the front surface 12A to the rear surface 12B thereof for allowing a corresponding pair of fasteners to be passed therethrough to secure the escutcheon plate 12 to an outlet receptacle, such as that generally illustrated by the reference numeral 136 in FIG. 6 and more completely described in U.S. Pat. No. 3,619,416, Rasmussen.

The centrally-located, connector-receiving aperture 40 is defined by a lower surface 43, a pair of side surfaces 44, a pair of upper surfaces 46, a pair of side surfaces 48, a pair of upper surfaces 50, a pair of side surfaces 52, and an inclined top surface 54, all extending between front surface 12A and rear surface 12B of escutcheon plate 12. The portion of the aperture 40 defined by lower surface 43, side surfaces 44, and upper surfaces 46 is generally complementary to, but slightly larger than, the body 20 of the male connector 10. Likewise, the portion of the aperture 40 defined in part by side surfaces 48 and upper surfaces 50 is generally complementary to, but slightly larger than, the ledge 28 and the portion of tab 34 between the pair of locking shoulders 32 and hinge portion 30. Finally, the remaining portion of aperture 40 defined in part by side surfaces 52 and inclined top surface 54 is generally complementary to, but slightly larger than, the necked-down end of tab 34.

Integral with escutcheon plate 12 and extending from the rear surface 12B thereof are a pair of spaced-apart, L-shaped projections 56 which are located in proximity to and partially above aperture 40, and a pair of spaced-apart, cylindrical projections 58 located below aperture 40.

Projections 56 and 58 serve to locate the body member 14 with respect to aperture 40 upon assembly of body member 14 to escutcheon plate 12, as will be hereinafter described. In addition, a lower surface of each of the L-shaped projections 56 lies in a common plane with respective ones of the upper surfaces 50 partially defining aperture 40 so that each of the L-shaped projections 56 abuts a respective one of the pair of locking shoulders 32 to retain male connector 10 upon insertion, as hereinafter described.

The body member 14 (FIGS. 1,2,3 and 5) includes a front wall member 64 and an integral, rear terminal-receiving member 66 which are injection-molded from a dielectric, insulating material. The connector-receiving cavity 60 extends fro a front surface 68 of front wall member 64 into both front wall member 64 and rear terminal-receiving member 66 and terminates at a rear surface 62 located within member 66.

The front wall member 64 is provided with upper and lower tabs 70, 72 which are respectively located and configured to be received between the upper legs of the pair of projections 56, and the pair of projections 58. Additionally, the front wall member 64 includes a rectangular key, formed in part by a pair of notches 76, which adjoins tab 70 and which is received between the lower legs of the pair of projections 56, when the front surface 68 of front wall member 64 is placed against the rear surface 12B of escutcheon plate 12.

The cavity 60 is defined by a low surface 78, a pair of side surfaces 80, a pair of upper surfaces 82, a pair of side surfaces 84, and an upper surface 86, all extending from the front surface 68 inwardly to the rear surface 62. Upon assembly of body member 14 with escutcheon plate 12, the lower surface 78 is substantially coplanar with lower surface 43, the side surfaces 80 are substantially coplanar with the side surfaces 44, the upper surfaces 82 are substantially coplanar with the upper surfaces 46, the side surfaces 84 are substantially coplanar with the side surfaces 48, and the upper surface 86 is substantially coplanar with the juncture between inclined top surface 54 and rear surface 12B.

Provided in cavity 60 are a pair of ledges 88 located at the junctures of lower surface 78 and side surfaces 80, and a pair of stop shoulders 90 located just below upper surfaces 82 and just to the inside of side surfaces 80, adjacent rear surface 62.

A plurality of bores 92 are provided in the member 14 which extend parallel to each other from the front surface 68 of front wall member 64 to a rear surface 93 of member 66 (FIG. 2). A corresponding plurality of grooves 94 are provided in lower surface 78 and extend from the front surface 68 to the rear surface 62. At the front surface 68, each of the plurality of grooves 94 communicates with a respective one of the plurality of bores 92. Provided in the rear member 66 are a plurality of terminal-receiving cavities 96 which extend inwardly from the rear surface 93. Each of the plurality of cavities 96 is hexagonal in configuration and is defined by a plurality of side wall surfaces 100 and a floor 102, with a central recess being provided in the floor 102. Each of the plurality of cavities 96 is connected to a corresponding one of the plurality of bores 92 by a groove 98, with each groove 98 having a bottom surface 106 which, at the point of entry into the respective cavity 96 through one of the plurality of side wall surfaces 100 thereof, is spaced apart from and above the floor 102 thereof. Each of the plurality of cavities 96 receives one of the plurality of electrical terminals 18, each terminal including a hexagonal nut 110, a hexagonal spacer 112, and a machine screw 114.

Figure 4:
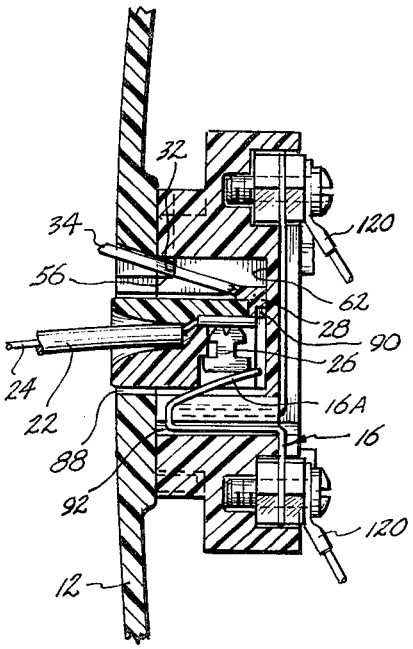
FIG. 4 is a side elevation view showing the component parts of the combined escutcheon plate and female connector of FIG. 1 in assembly, and also illustrating the male connector of FIG. 1 as inserted therein.
Figure 5:
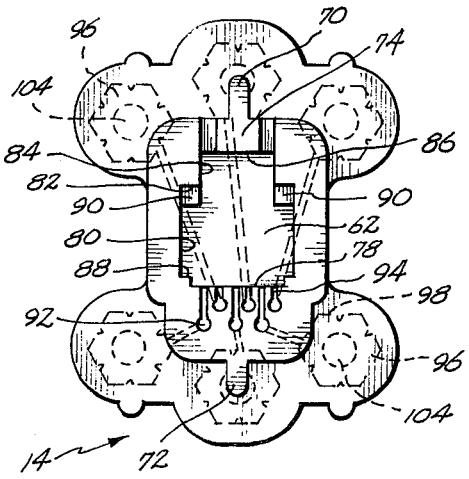
FIG 5 is a front elevation view showing the body member of the female connector.

Before assembly, each of the plurality of conductors 16 is formed into a first wire spring contact portion including a first leg 16A and a second leg 16B, with a third leg 16c also being formed with first leg 16A being spaced apart from and extending at an angle with respect to third leg 16C. Each of the conductors 16 is then assembled with body member 14, with the third leg 16C thereof being inserted into one of the plurality of bores 92 at the front surface 68 of front wall member 64. Accordingly, the first and second legs 16A, 16B of each conductor 16 are received in a corresponding one of the plurality of grooves 94 and a portion of each first leg 16A extends above the lower surface 78 of cavity 60, as best illustrated in FIG. 4.

A second portion of each conductor 16 protruding from the respective bore 92 beyond rear surface 93 of member 66 is then bent at a right angle to form a fourth leg 16D which, in assembly, is received within a corresponding one of the plurality of grooves 98. The length of each leg 16D is chosen so that the end thereof terminates at some point within the associated one of the plurality of terminal receiving cavities 96. Previous to this time, a nut 110 will have been placed in the cavity 96 so that the end of leg 16D within cavity 96 overlies the nut 100, by virtue of the spacing between the bottom surface 106 of groove 98 and the floor 102 of cavity 96. The spacer 112 is then placed into cavity 96 so that it overlies the end of the leg 16D. The assembly is completed by passing the machine screw 114 through the spacer 112 and into threaded engagement with the nut 110. Tightening of the machine screw 114 accordingly clamps the end of leg 16D between nut 100 and spacer 112, thereby providing electrical interconnection with the terminal 18. As illustrated in FIG. 4, an insulated conductor 120 may then be attached to the terminal 18 by stripping the end of the conductor 120, loosening machine screw 114, passing the stripped end of conductor 120 around the shank of machine screw 114, and retightening machine screw 114.

If desired, each of the grooves 98 may be potted with a suitable insulting compound after installation of the respective conductor 16. Also, a plurality of projections 108 are provided extending from the rear surface 93 for providing electrical isolation between the respective ones of the plurality of electrical terminals 18.

After assembly of the conductors 16 and terminals 18 to the body member 14, the resultant assembly is then brought into contact with the escutcheon plate 12 and secured thereto by any suitable adhesive or by any conventional ultrasonic bonding technique.

As best seen in FIG. 4, when the male connector 10 is inserted through the aperture 40 and into the cavity 60, the lower surface 20A thereof rides on the pair of ledges 88 to vertically position the connector 10, with horizontal positioning being afforded by a loose sliding fit between the side surfaces 20D thereof and the respective side surfaces 44, 80. Vertical alignment is also assured by a loose sliding fit between the upper surface 20C of connector 10 and the upper surfaces of 46, 82.

As connector 10 proceeds into the cavity 60, the first end of the tab 34 intermediate the pair of shoulders 32 and the hinge portion 30 comes into contact with the pair of upper surfaces 50, being deflected downwardly thereby until the ledge 28 abuts the rear surface 62 of cavity 60, at which point the shoulders 32 clear the extensions of upper surfaces 50 provided by the lower legs of projections 56, whereupon tab 24 returns to its original position, with shoulders 32 abutting the lower legs of projections 56 to lock the male connector 10 into position. At this point, the second end of the tab 34 is in contact with the inclined top surface 54. The male connector 10 can then be removed by simple depression of tab 34 to a point where locking shoulders 32 are below and out of engagement with projections 56.

During insertion of connector 10, each of the plurality of flat blade contacts 26 thereof comes into contact with a first leg 16A of one of the plurality of conductors 16. Further insertion of connector 10 causes downward deflection of each leg 16A, thereby insuring good electrical contact between the contact 26 and the associated conductor 16.

When the connector 10 has been fully inserted through the aperture 40 into cavity 60, the pair of stop shoulders 90 engage the respective pair of stop shoulders 36 on connector 10 to limit rotation of the connector 10 in direction transverse to the direction of insertion and removal.

Figure 7:
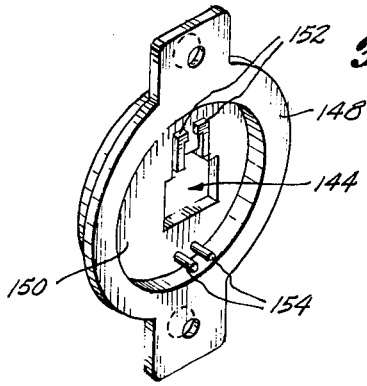
FIG. 7 is a pictorial view showing the rear of the adapter plate illustrated in FIG. 6.
Figure 8:
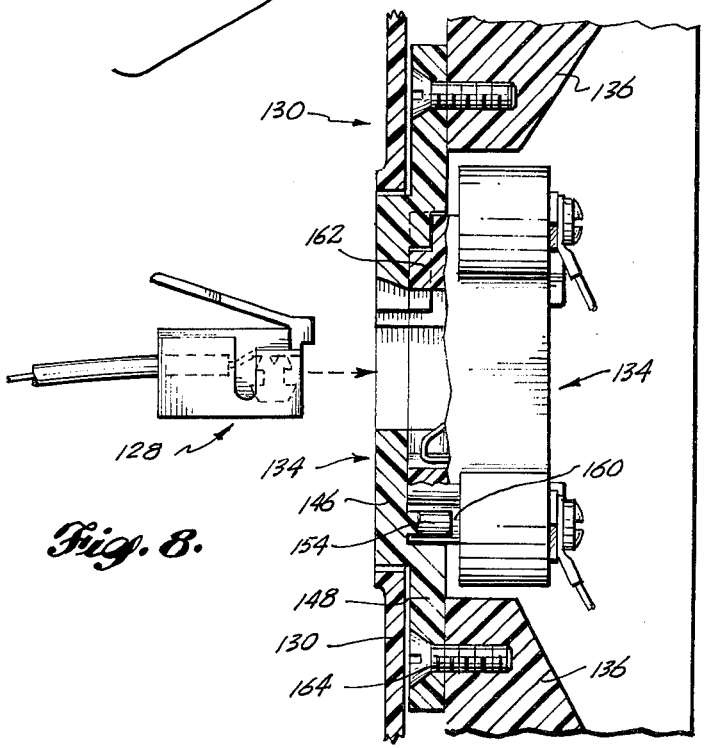
FIG. 8 is a side elevation view showing the component parts of the combined adapter plate and female connector of FIG. 6 in assembly, and also illustrating the relationship of a standardized male connector thereto.

Now turning to FIGS. 6-8, an embodiment of the invention is shown for use with a conventional escutcheon plate 130 having a centrally-located, knockout aperture 138 therein. In this embodiment, an adapter plate 132 is provided in place of escutcheon plate 12 for combination with a body member 134 identical in configuration to body member 14.

Adapter plate 132 has a cylindrical projection 146, of a size to fit through the knockout aperture 138, and an enlarged, integral base portion 148. A central, contact-receiving aperture 144 is provided through projection 146 and base portion 148 and is identical in configuration to aperture 40 in the escutcheon plate 12. As best seen in FIG. 7, a recess 150 is provided in the rear surface of base portion 148. A pair of L-shaped projections 152 and a pair of cylindrical projections 154 are located within the recess 150 and are identical in configuration, and in location with respect to the aperture 144, to the projections 56 and 58 of the escutcheon plate 12. Therefore, the provision of tabs 158 and 156 on a front wall member 162 of the body member 134 locates a connector-receiving cavity 156 thereof with respect to aperture 144 upon assemby of adapter plate 132 and body member 134, with the front wall member 162 being substantially contained within the recess 150. The assembly of adapter plate 132 and body member 134 is secured by the application of any suitable adhesive material or by conventional ultrasonic bonding.

An outlet receptacle 136, of a type disclosed in the aforementioned U.S.P. 3,619,476, is mounted in a wall. After electrical connection of terminals, not illustrated, within the body member 134 with leads within the outlet receptacle 136, the assembly of adapter 132 and body member 134 is then secured to the outlet receptacle 136 by a pair of fasteners 164 passing through corresponding apertures 166 in the base portion 148 and into threaded engagement with apertures 168 in the outlet receptacle 136. The escutcheon plate 130 is then installed by a pair of pins 140 passing into and being received by corresponding apertures 142 in outlet receptacle 136.

After assembly, as best illustrated in FIG. 8, a male connector 128, similar to male connector 10, can be inserted into and removed from the aperture 144 and cavity 156, inasmuch as the cylindrical projection 146 has a front surface which is flush with the outside surface of the escutcheon plate 130.

While the invention has been described with reference to a preferred embodiment, it is to be understood by those skilled in the art that the invention is not limited thereto, but rather is intended to be interpreted in accordance with the following claims.

What is claimed is:

1. An electrical termination including a female connector for telephone equipment which is adapted to be installed in wall-mounted outlet receptacles having pulled therein a plurality of electrical leads, and for use with a male connector including a body formed from dielectric material, the body being of substantially parallelopiped configuration and having a front surface and an adjoining lower surface, the male connector further including a plurality of metallic, flat blade contacts disposed in the body and spaced apart from each other, the flat blade contacts being exposed to the exterior of the body through the front and lower surfaces thereof, said electrical termination comprising:

a. plate means formed from dielectric material and including means for securing said plate means to the outlet receptacle, said plate means having a front surface, a back surface, and a connector-receiving aperture defined therein by a plurality of surfaces, including a lower surface, extending from said front surface to said back surface, said connector-receiving aperture being generally complementary to the body of the male connector;

b. a body member fromed from dielectric material and having a first surface and a second surface, a connector-receiving cavity being defined in said body member and extending inwardly from said first surface to a rear surface situated within said body member, said body member being joined to said plate means and with said first surface of said body member being adjacent to said rear surface of said plate means, said cavity being also defined by a plurality of surfaces including a lower surface, extending from said first surface to said rear surface which generally correspond to and which are aligned with said plurality of surfaces and said plate means in assembly so that said connector-receiving cavity is also complementary to the body of the male connector, a plurality of bores being defined in said body member and spaced apart from each other and extending through said body member from said first surface to said second surface, a plurality of first grooves spaced apart from each other in said lower surface of said connector-receiving cavity and extending from said first surface inwardly, each of said plurality of first grooves communicating adjacent said first surface with a corresponding one of said plurality of bores, a plurality of terminal-receiving cavities extending inwardly into said body member from said second surface, and a plurality of second grooves in said second surface of said body member, each of said plurality of second grooves interconnecting one of said plurality of terminal-receiving cavities with a corresponding one of said plurality of bores;

c. a plurality of electrical conductors, each being formed into a first wire spring contact portion located within one of said plurality of first grooves and extending from said first surface of said body member inwardly into said connector-receiving cavity for engaging a corresponding one of the plurality of flat blade contacts upon insertion of the male connector into said connector-receiving cavity through said connector-receiving aperture, each of said plurality of conductors also being formed into a second portion located in the corresponding one of said plurality of bores and second grooves and terminating in a corresponding one of said plurality of terminal receiving cavities; and d. a plurality of electrical terminal means, each of said electrical terminal means being located within one of said plurality of terminal receiving cavities and providing electrical interconnection between the termination of the corresponding one of said plurality of electrical conductors located therein and one of the pluality of leads in the outlet receptacle.

2. An electrical termination as recited in claim 1, wherein said plate means comprises an escutcheon plate which overlies the wall-mounted outlet receptacle when secured thereto.

3. An electrical termination as recited in claim 1, wherein said plate means comprises an adapter plate usable with an escutcheon plate having a centrally-located aperture, said adapter plate having a cylindrical projection defined in part by said front surface, said cylindrical projection protruding through the centrally-located aperture in the escutcheon plate when said adapter plate is secured to the wall-mounted outlet receptacle and the escutcheon plate is installed thereover.

4. An electrical termination as recited in claim 1, wherein each of said electrical terminal means comprises a nut, a spacer, and a machine screw, and wherein said each of said terminal-receiving cavities is configured to receive and retain said nut and said spacer with said spacer being exposed to the exterior of said body member and with the termination of the corresponding one of said plurality of electrical conductors being clamped between said nut and said spacer by said machine screw which is inserted into threaded engagement with said nut through said spacer, each said electrical terminal means providing for securement of one of the plurality of leads in the wall-mounted outlet receptacle between said spacer and said machine screw.

5. An electrical terminal as recited in claim 4, wherein each of said terminal-receiving cavities is defined by a plurality of side wall surfaces and a floor, and wherein each of said plurality of second grooves extends to and communicates with a corresponding one of said plurality of terminal-receiving cavities through one of said plurality of side wall surfaces, each of said second grooves having a bottom surface which is spaced apart from said floor of said corresponding terminal receiving cavity at the entry of said groove into said terminal receiving cavity through said one side wall surface so that the termination of the corresponding one of said plurality of electrical conductors overlies said nut received and retained in said corresponding terminal-receiving cavity.

6. An electrical termination as recited in claim 1, for use with a male connector also having an upper surface adjoining the front surface and a pair of side surfaces each adjoining the front, lower and upper surfaces thereof and further including a ledge having a first portion forming part of and extending from the front surface and a second portion forming part of and extending from the upper surface, a tab having a first end and a necked-down second end defining a pair of shoulders intermediate the first end and the second end, and a flexible hinge joining the first end of the tab to the second portion of the ledge so that the tab extends at an angle with respect to the upper surface:

a. wherein said plurality of surfaces in said plate means defining said connector-receiving aperture further include a pair of said plate surfaces substantially orthogonal to and adjoining said lower surface and generally complementary to the pair of side surfaces of the male connector, a pair of first upper surfaces each substantially orthogonal to and adjoining one of said pair of first side surfaces and generally complementary to the upper surfaces of the male connector, a pair of second side surfaces each substantially orthogonal to and adjoining one of said part of first upper surfaces, a pair of second upper surfaces each substantially orthogonal to and adjoining one of said pair of second side surfaces, said pair of second side surfaces and said pair of second upper surfaces being generally complementary to the ledge and first end of the tab of the male connector, a pair of third side surfaces each substantially orthogonal to and adjoining one of said pair of second upper surfaces, and a top surface joining said pair of third side surfaces and inclined with respect to said lower surface, said pair of third side surfaces and said top surface being generally complementary to the second, necked-down end of the tab of the male connector.

b. wherein said plurality of surfaces in said body member defining said connector-receiving cavity further include a pair of first said surfaces substantially orthogonal to and adjoining said lower surface and aligned with said pair of first side surfaces of said plate means in assembly, a pair of upper surfaces each substantially orthogonal to and adjoining one of said pair of first side surfaces and aligned with said pair of upper surfaces of said plate means in assembly, a pair of second side surfaces each substantially orthogonal to and adjoining one of said pair of upper surfaces said pair of second side surfaces being aligned with said pair of second side surfaces of said plate means in assembly, and a top surface adjoining and substantially orthogonal to said pair of second side surfaces and aligned with a junction between said inclined top surface of said plate means and said rear surface thereof upon assembly, c. whereupon the male connector is guided upon insertion through said connector-receiving aperture into said connector-receiving cavity so that the tab thereof is first depresses toward the upper surface thereof by frictional engagement between the first end of the tab and said pair of second upper surfaces of said plate means until the pair of shoulders on the tab pass the junctures between said second upper surfaces and said rear surface of the plate means, whereupon the tab returns to its original position with the pair of shoulders engaging said rear surface to said plate means adjacent said junctures of said pair of second upper surfaces with said rear surface and the second end of the tab being received in said terminal-receiving aperture between said pair of third side surfaces and said inclined top surface thereof to lock the male connector into position.

7. An electrical terminal as recited in claim 6, wherein said plate means further comprises a pair of projections located on said rear surface thereof in proximity to said connector receiving aperture, each of said pair of projections having a surface aligned with and extending one of said pair of second upper surfaces of said plate means, and wherein said body member includes a pair of notches in said first surface thereof, for each receiving a portion of one of said pair of projections, whereupon the male connector is locked into position when the pair of shoulders on the tab thereof clear said pair of projections of said plate means upon insertion of the male connector through said connector-receiving aperture.

8. An electrical terminal as recited in claim 7, wherein each of said pair of projections is L-shaped and has first and second legs, with said first leg of each projection extending substantially parallel to said pairs of side surfaces of said plate means and terminating in a first end including said lower surface thereof, and a second leg of each projection being extending substantially parallel to said pairs of lower and upper surfaces of said plate means and terminating in a second end, said second ends of said pair of L-shaped projections being spaced apart from each other; wherein said plate means further comprises a second pair of spaced-apart projections also located on the rear surface thereof in proximity to said lower surface of said connector-receiving aperture, and wherein said body member further includes first and second tabs respectively located to be received between said second ends of said pair of L-shaped projections and said second pair of spaced-apart projections to orient and align said body member with said plate means upon assembly thereof.

* * * * *

UNITED STATES PATENT AND TRADEMARK OFFICE

CERTIFICATE OF CORRECTION

PATENT NO. : 4,040,699

DATED : August 9, 1977

INVENTOR(S) : Harry R. Rasmussen

It is certified that error appears in the above-identified patent and that said Letters Patent are hereby corrected as shown below:

Column 10, line 28: delete "said plate" and insert therefor --first side--.

Column 10, line 37: delete "part" and insert therefor --pair--.

Column 10, line 53: delete "said" and insert therefor --side--.

Column 10, line 62: after "surfaces" insert a comma (--,--).

Column 10, line 67: delete "junction" and insert therefor —juncture--.

Column 11, line 6: delete "depresses" and insert therefor --depressed--.

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*